US007114562B2

(12) United States Patent
Fisseler et al.

(10) Patent No.: US 7,114,562 B2
(45) Date of Patent: Oct. 3, 2006

(54) APPARATUS AND METHOD FOR ACQUIRING INFORMATION WHILE DRILLING

(75) Inventors: Patrick Fisseler, Missouri City, TX (US); Tom Palmer, Stafford, TX (US); James Mather, Richmond, TX (US); Colin Longfield, Houston, TX (US); Richard Meehan, Sugar Land, TX (US); Jean-Marc Follini, Houston, TX (US); Jean-Michel Hache, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 43 days.

(21) Appl. No.: 10/707,152

(22) Filed: Nov. 24, 2003

(65) Prior Publication Data

US 2005/0109538 A1 May 26, 2005

(51) Int. Cl.
*E21B 47/00* (2006.01)

(52) U.S. Cl. ..... 166/250.02; 166/250.07; 166/100

(58) Field of Classification Search ..... 166/250.02, 166/250.07, 100; 175/50
See application file for complete search history.

(56) References Cited

U.S. PATENT DOCUMENTS

| | | | |
|---|---|---|---|
| 3,934,468 | A | 1/1976 | Brieger |
| 4,860,581 | A | 8/1989 | Zimmerman et al. |
| 4,893,505 | A | 1/1990 | Marsden et al. |
| 4,936,139 | A | 6/1990 | Zimmerman et al. |
| 4,984,633 | A | 1/1991 | Langer et al. |
| 5,339,037 | A | 8/1994 | Bonner et al. |
| 5,363,931 | A | 11/1994 | Moriarty |
| 5,419,395 | A | 5/1995 | Harvey et al. |
| 5,622,223 | A | 4/1997 | Vasquez |
| 5,803,186 | A | 9/1998 | Berger et al. |
| 6,026,915 | A | 2/2000 | Smith et al. |
| 6,152,220 | A | 11/2000 | Carmichael et al. |
| 6,157,893 | A | 12/2000 | Berger et al. |

(Continued)

FOREIGN PATENT DOCUMENTS

EP 0978630 * 2/2000

(Continued)

OTHER PUBLICATIONS

Lang, Karl, PVT Data in Time and Online, Apr. 2003, Hart's E&P.

*Primary Examiner*—William Neuder
(74) *Attorney, Agent, or Firm*—Jennis Salazar; Matthias Abrell; Victor H. Segura

(57) ABSTRACT

An apparatus and method useful for acquiring information from a subsurface formation penetrated by a wellbore contemplate the use of a tubular body adapted for connection within a drill string disposed in the wellbore. The tubular body is equipped with one or more protuberances (e.g., ribs) defining an expanded axial portion. A probe is carried by the tubular body at or near a first location within the expanded axial portion of the body where the cross-sectional area of the expanded axial portion is a minimum. The probe is movable between retracted and extended positions. In another aspect, the inventive apparatus may further include a cover releasably-secured about the probe for protecting the probe while drilling. In a further aspect, the inventive apparatus may include a shearable backup support carried by the tubular body azimuthally opposite the probe permitting release of the apparatus from the wellbore in the event of a failure. In yet another aspect, the probe is at least partially carried within a debris-clearing channel formed in a protruding portion of the tubular body to promote free movement of the probe within the wellbore.

87 Claims, 8 Drawing Sheets

U.S. PATENT DOCUMENTS

| | | | | |
|---|---|---|---|---|
| 6,179,066 | B1 | 1/2001 | Nasr et al. | |
| 6,230,557 | B1 | 5/2001 | Ciglenec et al. | |
| 6,435,275 | B1 | 8/2002 | Kirk et al. | |
| 6,564,883 | B1 | 5/2003 | Fredericks et al. | |
| 6,585,044 | B1 | 7/2003 | Rester et al. | |
| 6,622,803 | B1 | 9/2003 | Harvey et al. | |
| 6,729,399 | B1 * | 5/2004 | Follini et al. | 166/264 |
| 2003/0098156 | A1 | 5/2003 | Follini et al. | |
| 2004/0160858 | A1 * | 8/2004 | Ciglenec et al. | 367/83 |
| 2004/0178797 | A1 * | 9/2004 | Rioufol et al. | 324/367 |
| 2005/0072565 | A1 * | 4/2005 | Segura et al. | 166/100 |
| 2005/0115716 | A1 * | 6/2005 | Ciglenic et al. | 166/373 |

FOREIGN PATENT DOCUMENTS

| | | | |
|---|---|---|---|
| GB | 2333308 | A | 7/1999 |

* cited by examiner

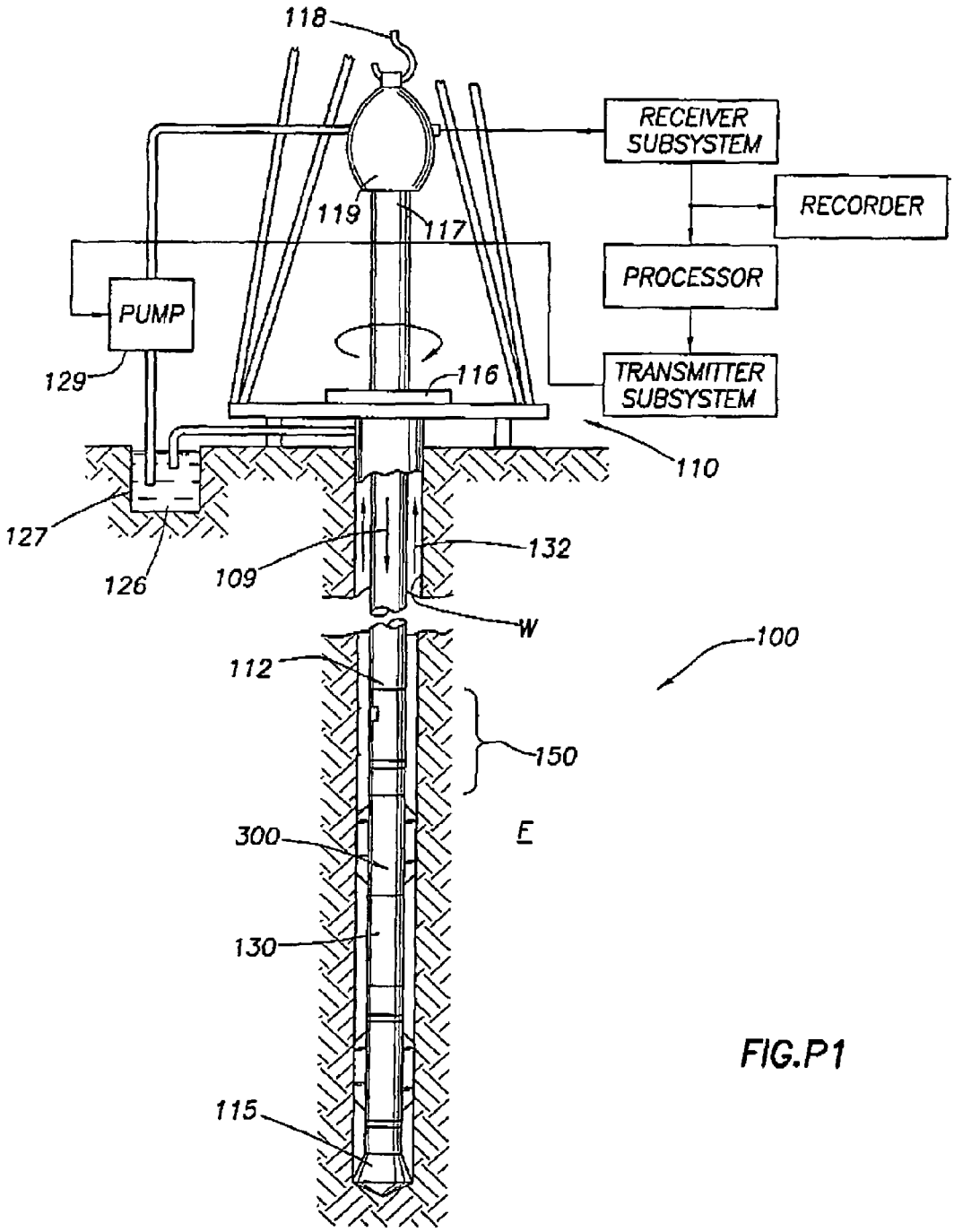
FIG.P1

A–A

APPARATUS AND METHOD FOR ACQUIRING INFORMATION WHILE DRILLING

BACKGROUND OF INVENTION

1. Field of the Invention

The present invention relates to the acquisition of information, such as pore pressure, from a subsurface formation while drilling. More particularly, the present invention relates to the stabilization and retrieval of apparatuses having utility for acquiring such information.

2. Background of the Related Art

Present day oil well operation and production involves continuous monitoring of various subsurface formation parameters. One aspect of standard formation evaluation is concerned with the parameters of reservoir pressure and the permeability of the reservoir rock formation. Continuous monitoring of parameters such as reservoir pressure and permeability indicate the formation pressure change over a period of time, and is essential to predict the production capacity and lifetime of a subsurface formation. Present day operations typically obtain these parameters through wireline logging via a "formation tester" tool. This type of measurement requires a supplemental "trip", i.e., removing the drill string from the wellbore, running a formation tester into the wellbore to acquire the formation data and, after retrieving the formation tester, running the drill string back into the wellbore for further drilling. Thus, it is typical for formation parameters, including pressure, to be monitored with wireline formation testing tools, such as those tools described in U.S. Pat. Nos. 3,934,468; 4,860,581; 4,893,505; 4,936,139; and 5,622,223.

Each of the aforementioned patents is therefore limited in that the formation testing tools described therein are only capable of acquiring formation data as long as the wireline tools are disposed in the wellbore and in physical contact with the formation zone of interest. Since "tripping the well" to use such formation testers consumes significant amounts of expensive rig time, it is typically done under circumstances where the formation data is absolutely needed or it is done when tripping of the drill string is done for a drill bit change or for other reasons.

The availability of reservoir formation data on a "real time" basis during well drilling activities is a valuable asset. Real time formation pressure obtained while drilling will allow a drilling engineer or driller to make decisions concerning changes in drilling mud weight and composition as well as penetration parameters at a much earlier time to thus promote safe drilling. The availability of real time reservoir formation data is also desirable to enable precision control of drill bit weight in relation to formation pressure changes and changes in permeability so that the drilling operation can be carried out at its maximum efficiency.

It is desirable therefore to provide an apparatus for well drilling that enables the acquisition of various formation data from a subsurface formation of interest while the drill string with its drill collars, drill bit and other drilling components are present within the well bore, thus eliminating or minimizing the need for tripping the well drilling equipment for the sole purpose of running formation testers into the wellbore for identification of these formation parameters.

More particularly, it is desirable to provide an apparatus that employs an extendable probe for contacting the wellbore wall during a measurement sequence in the midst of drilling the wellbore. The probe is typically positioned inside a portion of the drill string such as a tool collar during normal drilling operation. The section of such a collar that surrounds the probe is an important component of the tool, and its design has an impact on the quality of the measurement, the reliability of the tool and its ability to be used during drilling operations.

The section surrounding the probe, however, is typically not suitable for protecting the probe in its extended position against mechanical damage (cutting, debris, shocks to the wellbore wall, abrasion) and from erosion (from the fluids circulating in the annulus).

It is furthermore well known that the velocity of circulation fluids inside a wellbore has a direct effect on the thickness and integrity of the mud cake (the higher the velocity, the lower the sealing capabilities of the mud cake), which in turn will result in a local increase of the formation pressure near the wellbore wall (also called dynamic supercharging). This effect typically reduces the accuracy of the formation pressure as measured by a probe on a tool. In order to reduce the velocity effects when such a tool is operated and fluids are circulated in the wellbore, it is desirable to increase the flowing area in the annulus, thus reducing fluid velocity near the probe.

Many tools used for taking measurements (wireline and drill string conveyed) employ a pad, piston, or other device that is hydraulically or mechanically extended in association with, or opposite, a probe to make contact with the wellbore wall. Problems arise when there is a failure within the tool or the actuator extending and retracting these devices, leaving the tool deployed or set in the hole. Often times, the retrieval of the tool under such circumstances will permanently damage the hydraulic pistons leaving the tool inoperable or worse, lead to hydraulic leak possibly causing the tool to flood with mud. It is therefore further desirable to incorporate a system in such tools that permits the tools to be withdrawn when faced with such a failure without impacting the operation of the hydraulic and/or mechanical components.

SUMMARY OF INVENTION

In one aspect, the present invention provides an apparatus for acquiring information from a subsurface formation penetrated by a wellbore. The apparatus includes a tubular body adapted for connection within a drill string disposed in the wellbore. The tubular body is equipped with one or more protuberances along an axial portion thereof defining an expanded axial portion. A probe is carried by the tubular body at or near a first location within the expanded axial portion of the body where the cross-sectional area of the expanded axial portion is a minimum. The probe is movable between retracted and extended positions. An actuator is carried by the tubular body for moving the probe between its retracted and extended positions, the extended position being for engaging the wall of the wellbore and acquiring information from the formation, and the retracted position being for protecting the probe while drilling.

In various embodiments according to this aspect of the invention, the tubular body may be a drill collar, a stabilizer equipped with a plurality of ribs for stabilizing the drill string, or a centralizer equipped with a plurality of ribs for centralizing the drill string.

The tubular body is, in a particular embodiment, equipped with a first rib that spans substantially the length of the expanded axial portion, and second and third ribs each having a length less than half the length of the first rib. The second and third ribs of this embodiment are disposed on opposing sides of the midpoint of the expanded axial portion. The first location lies at the midpoint of the expanded axial portion.

The tubular body may be further equipped with a fourth rib that spans substantially the length of the expanded axial portion radially opposite the first rib.

In a particular embodiment, the first rib is helicoidal near its ends and axially linear intermediate its ends. In various embodiments, each of the ribs may be one of helicoidal, oblique, and axially linear. Furthermore, one or more of the ribs may have a thickness that varies over its length.

In a particular embodiment of the inventive apparatus, the probe includes a conduit disposed within an annular seal, and a sensor in fluid communication with the conduit for measuring a property of the formation. The sensor may, e.g., be a pressure sensor adapted for measuring the pore pressure of the formation.

The actuator of the inventive apparatus may employ hydraulic fluid or electrical power to move the probe.

According to a particular embodiment of the apparatus, the first location lies on a protuberance within the expanded axial portion, and the probe is at least partially carried within a channel formed in the protuberance at or near the first location. The protuberance extends radially beyond the retracted probe such that the probe is recessed within the protuberance when the probe is retracted. The channel has a width sized for closely bounding a portion of the probe and the channel extends azimuthally from the probe through one side of the protuberance, whereby wellbore debris is free to flow along the channel away from the probe during drilling.

The channel may extend azimuthally in a clockwise direction from the probe.

The inventive apparatus may further include a cover releasably-secured about the probe for protecting the probe while drilling prior to the probe being first moved to its extended position. In this manner, the movement of the probe by the actuator to the probe's extended position releases the cover from the probe and positions the probe in engagement with the wall of the wellbore for acquiring information from the formation.

Still further, the inventive apparatus may include a backup support carried by the tubular body azimuthally opposite the probe and movable between retracted and extended positions. The backup support is designed to shear at a preselected location upon encountering a predetermined shear load. A backup support actuator is also carried by the tubular body for moving the backup support between its retracted and extended positions. The extended position is for assisting the engagement of the probe with the wall of the wellbore, and the retracted position is for protecting the backup support while drilling.

The probe is, in a particular embodiment, substantially cylindrical and is carried for movement within a bore in the protuberance within the expanded axial portion. In the embodiment where the probe is at least partially carried within a channel formed in the protuberance at or near the first location, the bore penetrates the channel.

In another aspect, the present invention provides an apparatus for acquiring information from a subsurface formation penetrated by a wellbore. Accordingly, the apparatus includes a tubular body adapted for connection within a drill string disposed in the wellbore, and a probe at least partially carried within a channel formed in a protruding portion of the body for movement of the probe between retracted and extended positions. The protruding portion extends radially beyond the probe such that the probe is recessed within the protuberance when the probe is retracted. The channel has a width sized for closely bounding a portion of the probe, and the channel extends azimuthally from the probe through one side of the protuberance. In this manner, wellbore debris is free to flow along the channel away from the probe during drilling. The inventive apparatus further includes an actuator carried by the body for moving the probe between its retracted and extended positions. The extended position disposes the probe radially beyond the protruded portion of the body for engaging the wall of the wellbore and acquiring information from the formation. The retracted position is for protecting the probe while drilling.

The apparatus according to this second inventive aspect may otherwise be equipped in accordance with the above-described embodiments of the first inventive aspect.

In yet another aspect, the present invention provides an apparatus for acquiring information from a subsurface formation penetrated by a wellbore. The apparatus according to this aspect includes a tubular body adapted for connection within a drill string disposed in the wellbore, a probe carried by the body for movement of the probe between retracted and extended positions, and a cover releasably-secured about the probe for protecting the probe while drilling prior to the probe being first moved to its extended position. An actuator is also carried by the body for moving the probe between its retracted and extended positions. The movement of the probe to its extended position releases the cover from the probe and positions the probe in engagement with the wall of the wellbore for acquiring information from the formation. The movement of the probe to its retracted position is for protecting the probe while drilling.

In a particular embodiment according to this aspect of the invention, the probe is substantially cylindrical and carried for movement within a bore in a protuberance formed along a portion of the body. The cover of this embodiment has a continuous cylindrical side wall sized to closely fit in an annulus formed between the probe and the wall of the bore in the protuberance when the probe is retracted.

More particularly, according to an alternative version of this embodiment, a first annular groove is formed in the wall of the bore in the protuberance, and a second annular groove is formed in the side wall of the cover. The first and second grooves align to form a toroidal space when the cover is secured about the probe. A shearable ring is disposed in the toroidal space for releasably securing the cover to the bore of the protuberance.

Alternatively according to this embodiment, an annular groove is formed in the wall of the bore in the protuberance, and the side wall of the cover is equipped with a shearable annular flange at an end thereof adapted to fit the annular groove.

The apparatus according to this third inventive aspect may otherwise be equipped in accordance with the above-described embodiments of the first inventive aspect.

In accordance with a still further aspect, the present invention provides an apparatus for acquiring information from a subsurface formation penetrated by a wellbore. The apparatus according to this aspect includes a tubular body adapted for connection within a drill string or along a wireline disposed in the wellbore, a probe carried by the body for movement of the probe between retracted and extended positions, and a backup support carried by the body radially opposite the probe and movable between retracted and extended positions. The backup support is designed to shear at a preselected location upon encountering a predetermined shear load. A probe actuator is carried by the tubular body for moving the probe between its retracted and extended positions. The extended position is for engaging the wall of the wellbore and acquiring information from the formation, and the retracted position is for protecting the probe while drilling. A backup support actuator is also carried by the body for moving the backup support between its retracted and extended positions. The extended position is for assisting the engagement of the probe with the wall of the wellbore, and the retracted position is for protecting the backup support while drilling.

In a particular embodiment, the backup support includes a piston body carried within a bore in the tubular body for movement between extended and retracted positions, and a piston head carried at least partially within a bore in the piston body for movement between extended and retracted positions. The piston head is designed to shear upon encountering the predetermined shear load.

The shear design of the piston head may be accomplished by material selection. For example, the piston head may includes a material having a relatively low shear strength. Suitable materials include aluminum alloys and oriented strand composites. The shear may be achieved by erosion and/or by shear failure.

The shear design of the piston head may also be accomplished either independently or in combination with material selection by mechanical tuning. For example, the piston head may include a central base formed of metal and an outer composite jacket secured about the central base. In this embodiment, the central base may have grooves formed therein for engagement by the composite jacket. Such grooves may serve as preferential shear failure sites, since they will reduce the cross-sectional area of the piston head.

More particularly, the composite jacket has an enlarged outer diameter at a distal end, forming a mushroom-shaped head having a shoulder. The shoulder has radial grooves formed therein providing channels for debris to flow clear of the shoulder, thereby reducing the likelihood of debris becoming trapped between the head and the tubular body when the piston head is moved to its retracted position.

The apparatus according to this fourth inventive aspect may otherwise be equipped in accordance with the above-described embodiments of the first inventive aspect.

A method according to a fifth aspect of the invention includes the step of equipping a tubular body with one or more protuberances along an axial portion thereof defining an expanded axial portion. The tubular body is further equipped with a movable probe at or near a first location on the tubular body within the expanded axial portion where the cross-sectional area of the expanded axial portion is a minimum. The tubular body is connected within a drill string, and the drill string is disposed within the wellbore. With the tubular body so equipped, the probe is selectively extended such that the probe engages the wall of the wellbore for acquiring information from the formation. The probe is also selectively retracted to protect the probe while drilling.

A method according to a sixth aspect of the invention includes the step of equipping a tubular body with a protruding portion having a channel formed therein, and a movable probe carried at least partially within the channel. The channel extends transversely through at least one side of the protruding portion. The tubular body is connected within a drill string, and the drill string is disposed within the wellbore. The probe is selectively extended such that the probe engages the wall of the wellbore for acquiring information from the formation. The probe is also selectively retracted to a recessed position within the protruded portion whereby wellbore debris is free to flow along the channel away from the probe during drilling.

A method according to a seventh aspect of the invention includes the step of equipping a tubular body with a movable probe having a releasable cover. The cover is designed to be released by extension of the probe from a retracted position. The tubular body is connected within a drill string, and the drill string is disposed within the wellbore. The probe is selectively extended from the retracted position to release the cover and move the probe into engagement with the wall of the wellbore for acquiring information from the formation. The probe is also selectively retracted to protect the probe while drilling.

A method according to an eighth aspect of the invention includes the step of equipping a tubular body with a movable probe, and a movable backup support positioned radially opposite the probe. The backup support is designed to shear at a preselected location upon encountering a predetermined shear load. The tubular body is connected within a drill string, and the drill string is disposed within the wellbore. The probe is selectively extended into engagement with the wall of the wellbore for acquiring information from the formation, and is selectively retracted to protect the probe while drilling. The backup support is selectively extended into engagement with the wall of the wellbore radially opposite the probe to supplement the engagement by the probe with the wellbore wall. The backup support is also selectively retracted as required while drilling. Upon failure to retract the backup support, a shear load at least as great as the predetermined shear load is applied to the backup support to shear the backup support at the preselected location.

BRIEF DESCRIPTION OF DRAWINGS

So that the above recited features and advantages of the present invention can be understood in detail, a more particular description of the invention, briefly summarized above, may be had by reference to the embodiments thereof that are illustrated in the appended drawings. It is to be noted, however, that the appended drawings illustrate only typical embodiments of this invention and are therefore not to be considered limiting of its scope, for the invention may admit to other equally effective embodiments.

FIG. P1 illustrates a convention drilling rig and drill string in which the present invention can be utilized to advantage.

DETAILED DESCRIPTION

Figure 1:
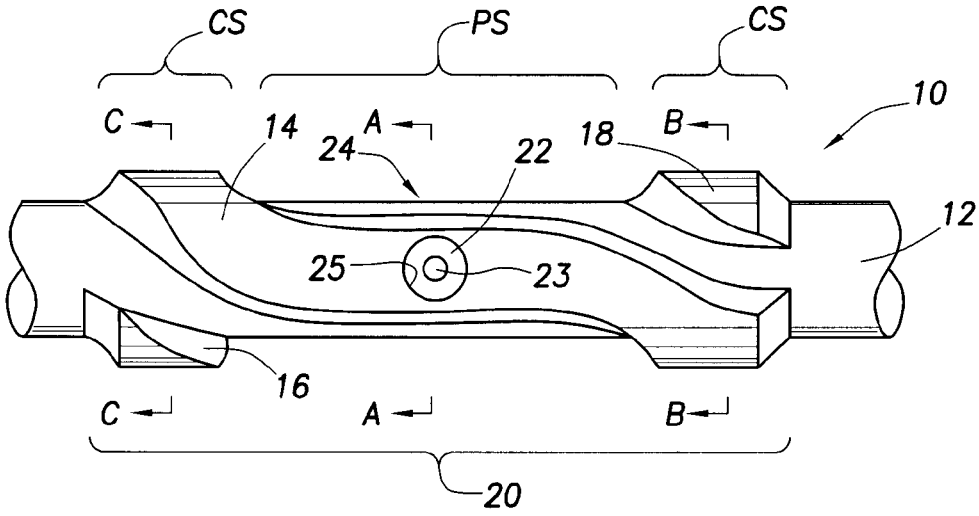
FIG. 1 is a side view of one embodiment of an apparatus for acquiring information from a subsurface formation in accordance with one aspect of the present invention.

FIG. P1 illustrates a convention drilling rig and drill string in which the present invention can be utilized to advantage. A land-based platform and derrick assembly 110 are positioned over wellbore W penetrating subsurface formation F. In the illustrated embodiment, wellbore W is formed by rotary drilling in a manner that is well known. Those of ordinary skill in the art given the benefit of this disclosure will appreciate, however, that the present invention also finds application in directional drilling applications as well as rotary drilling, and is not limited to land-based rigs.

Drill string 112 is suspended within wellbore W and includes drill bit 115 at its lower end. Drill string 112 is rotated by rotary table 116, energized by means not shown, which engages kelly 117 at the upper end of the drill string. Drill string 112 is suspended from hook 118, attached to a traveling block (also not shown), through kelly 117 and rotary swivel 119 which permits rotation of the drill string relative to the hook.

Drilling fluid or mud 126 is stored in pit 127 formed at the well site. Pump 129 delivers drilling fluid 126 to the interior of drill string 112 via a port in swivel 119, inducing the drilling fluid to flow downwardly through drill string 112 as indicated by directional arrow 109. The drilling fluid 126 exits drill string 112 via ports in drill bit 115, and then circulates upwardly through the annulus between the outside of the drill string and the wall of the wellbore, as indicated by direction arrows 132. In this manner, the drilling fluid lubricates drill bit 115 and carries formation cuttings up to the surface as it is returned to pit 127 for recirculation.

The drill string 112 further includes a bottom hole assembly, generally referred to as 100, near the drill bit 115 (in other words, within several drill collar lengths from the drill bit). The bottom hole assembly includes capabilities for measuring, processing, and storing information, as well as communicating with the surface. The assembly 100 further includes drill collar 130 for performing various other measurement functions, and surface/local communications subassembly 150.

Drill string 112 is further equipped in the embodiment of FIG. P1 with stabilizer collar 300. Such stabilizing collars are utilized to address the tendency of the drill string to "wobble" and become decentralized as it rotates within the wellbore, resulting in deviations in the direction of the wellbore from the intended path (for example, a straight vertical line). Such deviation can cause excessive lateral forces on the drill string sections as well as the drill bit, producing accelerated wear. This action can be overcome by providing a means for centralizing the drill bit and, to some extent, the drill string, within the wellbore. Examples of centralizing tools that are known in the art include pipe protectors and other tools, in addition to stabilizers. The present invention has application in each of such tools, as well as others, although it will now be described in general terms.

FIG. 1 illustrates a drill string apparatus 10 for acquiring information from a subsurface formation penetrated by a wellbore W. In a first aspect, the apparatus 10 includes a tubular body 12 adapted for connection within a drill string disposed in the wellbore W in a manner such as that shown in FIG. P1. The tubular body 12 is equipped with one or more protuberances 14, 16, 18 along an axial portion thereof defining an expanded axial portion 20. The term "protuberant"is used herein to include portions of the apparatus 10 that thrust outwardly from the tubular body 12, and includes "ribs," "blades," "lugs," and "wings"(all of which are used interchangeably) that tend to stabilize or centralize the tubular body by contact with the wellbore wall W.

A probe 22 is carried by the tubular body 12 at or near a first location 24 within the expanded axial portion 20 of the body 12 where the cross-sectional area of the expanded axial portion 20 is a minimum. The probe 22 is movable between retracted and extended positions in a manner that is well known in the art. A hydraulic or electrical actuator (not shown) is carried by the tubular body 12 for moving the probe 22 between its retracted and extended positions. The extended position permits the probe 22 to engage the wall of the wellbore W (see, e.g., FIG. 4) and acquire information from a subsurface formation of interest, while the retracted position (see, e.g., FIG. 11B) is for protecting the probe while drilling. An example of a hydraulic actuator that may be used to advantage is described in U.S. Pat. No. 6,230,557 commonly assigned to the assignee of the present application.

Figure 2:
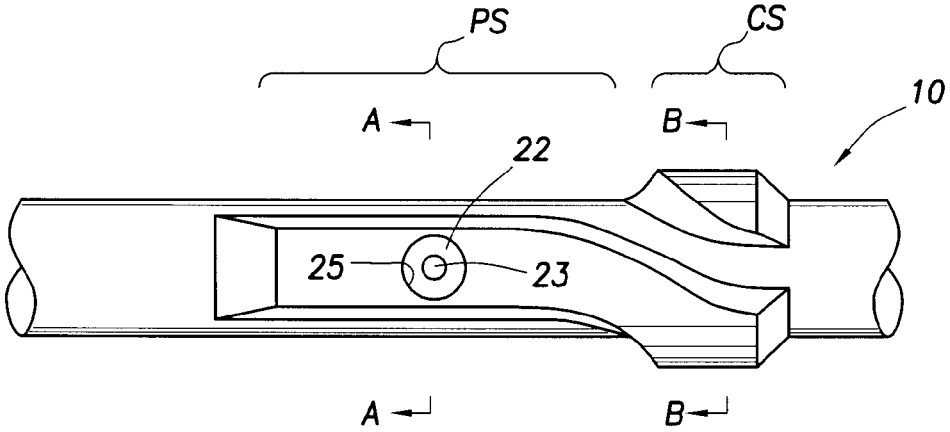
FIG. 2 is a side view of another embodiment of the apparatus for acquiring information from a subsurface formation.

With reference now to FIGS. 1 and 2, apparatus 10 is shown to incorporate two sections that may be referred to as a protective section PS and centralizing section(s) CS. Together, the two sections improve the reliability of the apparatus 10 as well as the quality of the measurement that it provides.

The primary purpose of the protective section PS is to protect the probe 22 against mechanical damage resulting from cuttings, debris, shocks to the wellbore wall W, and abrasion, as well as from erosion resulting from the fluids circulating in the wellbore annulus. It is well known that the velocity of fluids, such as drilling mud 126, circulating inside a wellbore has a direct effect of the thickness and integrity of the mud cake, i.e., the higher the velocity, the lower the sealing capabilities of the mud cake. This, in turn, will result in a local increase of the formation pressure near the wellbore wall W, known in the art as "dynamic supercharging." This effect typically reduces the accuracy of the formation pressure as measured by the probe 22 on the apparatus 10. In order to reduce these velocity effects when such a tool is operated and fluids are circulated in the wellbore, the cross-section of the apparatus 10 in the protective section PS is preferably kept to a minimum (see, e.g., FIG. 4), resulting in a larger flowing area in the annulus, and thus reducing fluid velocity near the probe 22.

Figure 5:
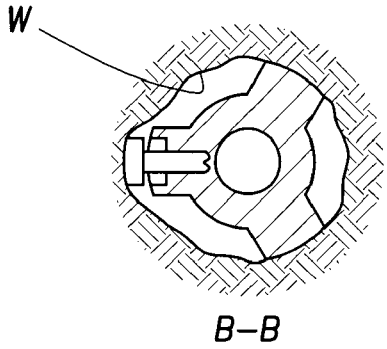
Figure 6:
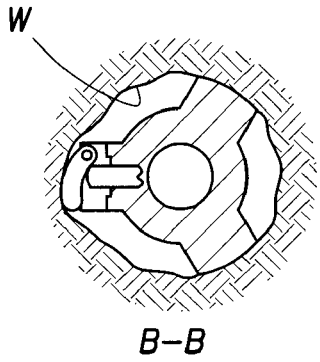

A typical operation of apparatus 10 imposes high contact forces on the probe 22. It is therefore possible, and generally advisable, to dispose one or more back-up supports such as a back-up piston (see FIG. 5) or a back-up support plate (see FIG. 6) inside one of the protuberances 14, 16, 18 of the centralizing section CS for movement between extended and retracted positions (described further below). Such devices may alternatively be disposed inside the protuberances within the protective section PS, although this is not presently preferred. The back-up support may be actuated hydraulically or mechanically in ways that are also well known in the art. An example of a suitable hydraulic actuator is described in U.S. Patent Application No. US 2003/0098156 A1 which is commonly assigned to the assignee of the present invention.

Figure 3:
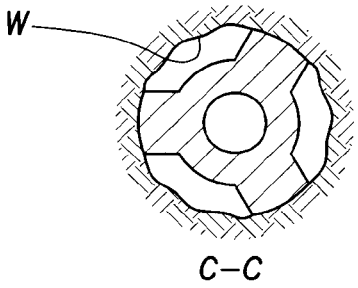
FIGS. 3–6 are simplified cross-sectional views of the apparatus according to the embodiments shown in FIGS. 1 and 2.

FIG. 1 shows an example of the apparatus 10 having two centralizing sections CS; FIG. 2 shows an example of the apparatus 10 with only one centralizing section CS. The primary purpose of the centralizing section(s) CS is to centralize the apparatus 10 inside the wellbore wall W to ensure a better sealing of the probe 22 when it is moved to a deployed position. The profile of the centralizing section is similar to a conventional spiral-blade stabilizer in order to reduce the shocks on the apparatus 10 during rotary drilling, and also reduce torque and drag. An example of three-blade section(s) CS is given in FIG. 3, but four or more blades are also possible.

In various embodiments according to this aspect of the invention, the tubular body 12 of the apparatus 10 may be a drill collar, a stabilizer (rotating or non-rotating) equipped with a plurality of ribs/blades for stabilizing the drill string, or a centralizer equipped with a plurality of ribs/blades for centralizing the drill string.

The tubular body 12 is, in the particular embodiment shown in FIG. 1, equipped with a protuberance 14 defining a first rib that spans substantially the length of the expanded axial portion 20. The tubular body 12 is also equipped with protuberances 16, 18 defining second and third ribs, each having a length less than half the length of the first rib 14. The second and third ribs 16, 18 of this embodiment are disposed on opposing sides of the midpoint of the expanded axial portion 20. The first location 24 lies at the midpoint of the expanded axial portion 20.

Figure 7A:
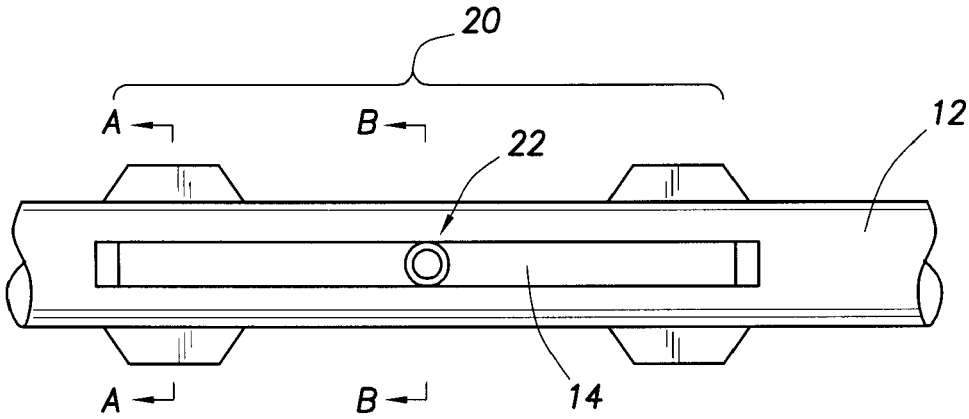
FIG. 7A is a side view of a third embodiment of the apparatus for acquiring information from a subsurface formation.
Figure 7B:
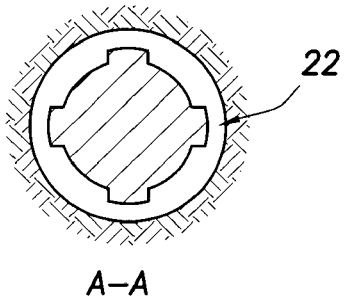
FIGS. 7B–7C are cross-sectional views of the apparatus according to the embodiment shown in FIG. 7A.
Figure 7C:
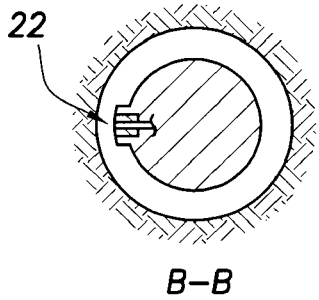
Figure 8:
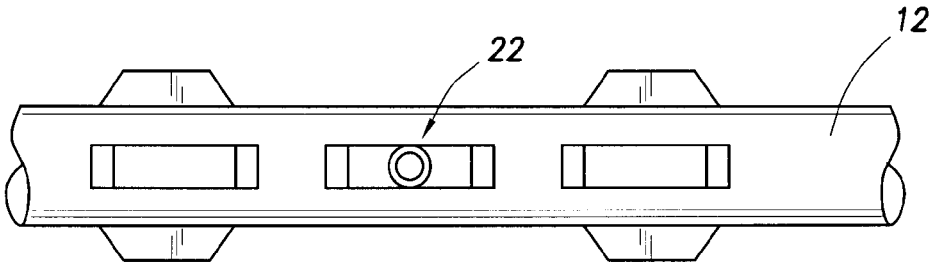
FIG. 8 is a side view of a fourth embodiment of the apparatus for acquiring information from a subsurface formation.
Figure 9:
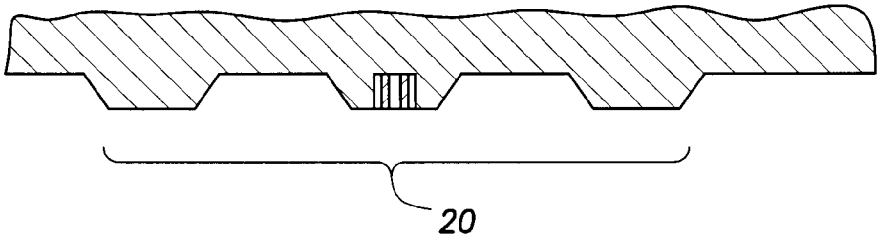
FIG. 9 is a partial sectional view of the apparatus according to the embodiment shown in FIG. 8.
Figure 10A:
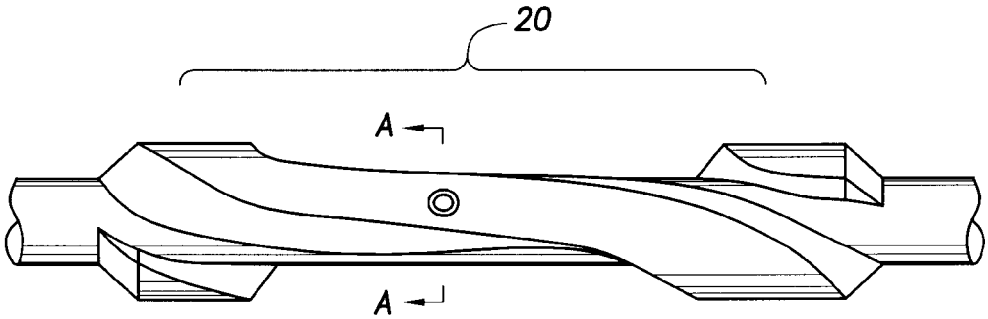
FIG. 10A is a side view of a fourth embodiment of the apparatus for acquiring information from a subsurface formation.
Figure 10B:
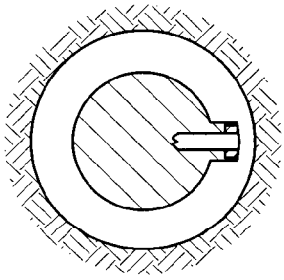
FIG. 10B is a cross-sectional view of the apparatus according to the embodiment shown in FIG. 10A.

The tubular body 12 may be further equipped with a fourth rib that spans substantially the length of the expanded axial portion radially opposite the first rib (see, e.g., FIGS. 7A–7B). Other configurations are depicted in FIGS. 7C, 8, 9, 10A and 10B.

In the embodiment of FIG. 1, the first rib 14 is helicoidal near its ends and axially linear intermediate its ends. In various embodiments, each of the ribs may be one of helicoidal, oblique, and axially linear (see FIG. 7A). Furthermore, one or more of the ribs may have a thickness that varies over its length (see FIG. 10A).

Figure 4:
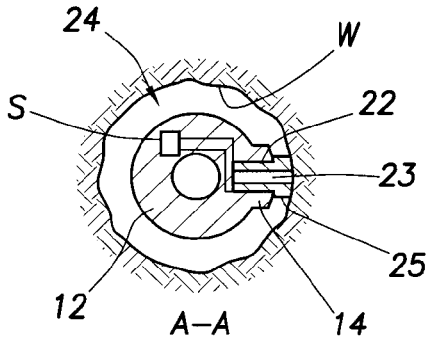

With reference now to FIG. 4, the probe 22 typically includes a conduit 23 disposed within an annular seal, or "packer," 25, and a sensor S in fluid communication with the conduit 23 for measuring a property of the formation. The sensor may, e.g., be a pressure sensor adapted for measuring the pore pressure of the formation once the probe is extended into engagement with the wellbore wall W.

Figure 11A:
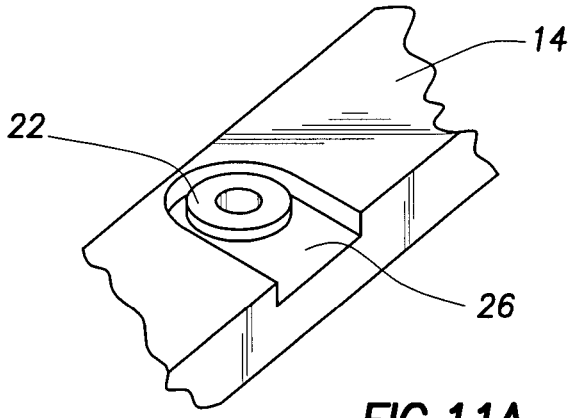
FIG. 11A is a perspective view of a stabilizer blade of an apparatus for acquiring information from a subsurface formation in accordance with another aspect of the present invention, the stabilizer blade having a debris channel.
Figure 11B:
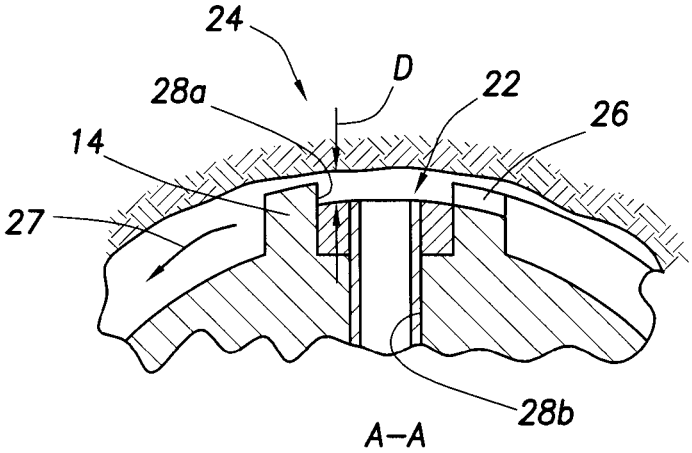
FIG. 11B is a sectional, elevational view of the stabilizer blade shown in FIG. 11A.
Figure 11C:
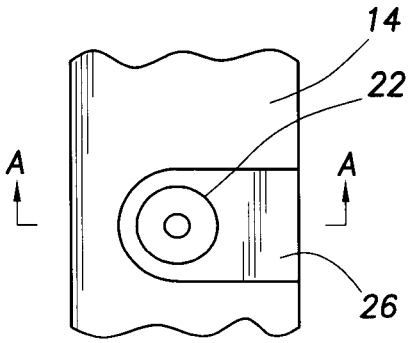
FIG. 11C is a plan view of a portion of the stabilizer blade shown in FIG. 11A.
Figure 12:
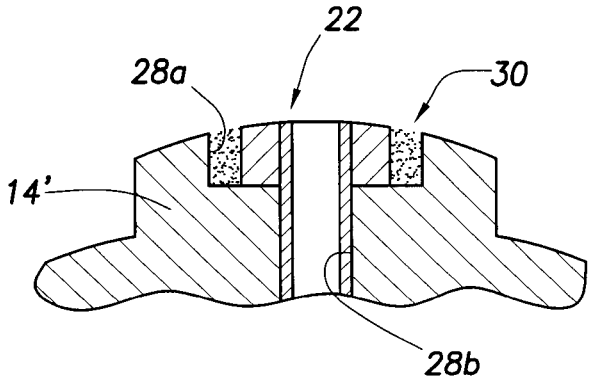
FIG. 12 is a sectional, elevational view of a stabilizer blade similar to that shown in FIG. 1B, but without a debris channel or probe recess space.

According to a particular embodiment of the apparatus represented by FIGS. 11A–11C, the first location 24 lies on a rib 14 within the expanded axial portion 20, and the probe 22 is at least partially carried within a bore 28*a*/28*b* within a channel 26 formed in the rib at or near the first location 24 (see also FIG. 1). The rib 14 extends radially beyond the retracted probe 22 such that the probe is recessed by a distance D within the rib when the probe is retracted. The channel 26 has a width sized for closely bounding a portion of the probe 22 (i.e., packer 25) and the channel extends transversely (generally azimuthally) from the probe through a side of the rib 14 opposite the direction of drill string rotation (assuming rotary drilling; see arrow 27), as shown particularly in FIGS. 11A and 11C. In this manner, wellbore debris is free to flow along the channel 26 away from the probe 22 during drilling. This may be contrasted with the rib 14' shown in FIG. 12, which has no debris channel or probe recess depth D, and consequently exhibits a buildup of debris 30 that can impede the movement of the probe 22 within upper bore region 28*a*.

Figure 14:
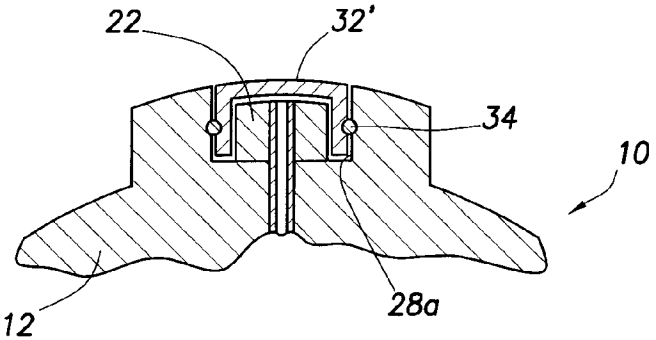
FIGS. 14–15 are sectional, elevational views of alternative versions of the protective cover shown in FIGS. 13A–13B.
Figure 15:
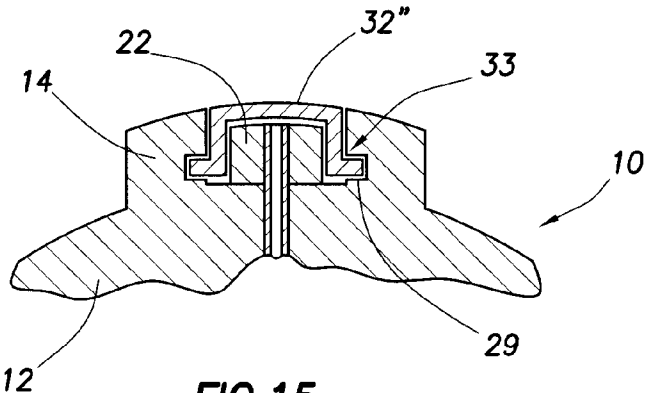
Figure 13A:
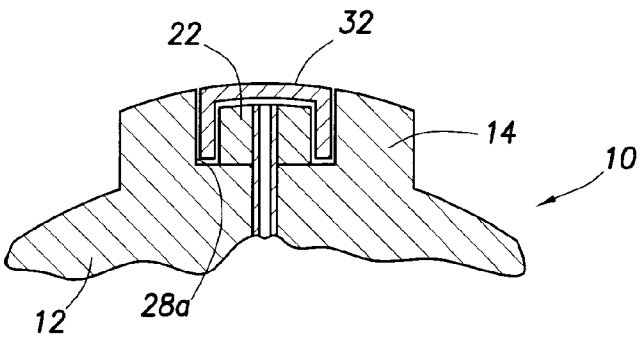
FIGS. 13A–13B are sequential sectional, elevational views of a probe within a stabilizer blade of an apparatus for acquiring information from a subsurface formation in accordance with a third aspect of the present invention, the probe releasing a protective cover as the probe moves from a retracted to an extended position.
Figure 13B:
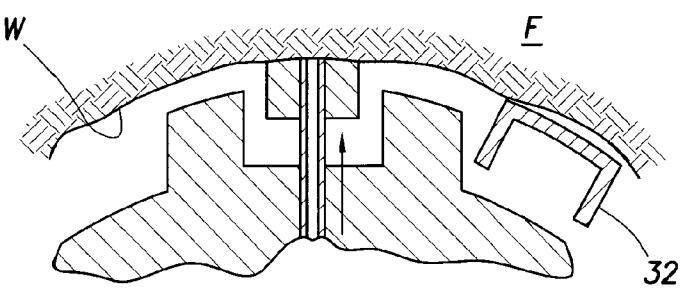

With reference now to FIGS. 13–15, the inventive apparatus may further include a cover 32 releasably-secured about the probe 22 within upper bore region 28*a* for protecting the probe while drilling prior to the probe being first moved from bore region 28*a* to its extended position. In this manner, the movement of the probe by the probe actuator (not shown) to the probe's extended position (see FIG. 13B) releases the cover 32 from the probe and positions the probe in engagement with the wall W of the wellbore for acquiring information from the formation F. The cover 32 is made of a drillable material.

In a typical embodiment according to this aspect of the invention, the probe 22 is substantially cylindrical and is carried for movement within the bore 28*a*/28*b* in a protuberance (e.g., rib 14) formed along a portion of the tubular body 12 of the apparatus 10. The cover 32 has a continuous cylindrical side wall sized to closely fit in an annulus formed between the probe 22 and the wall of the bore region 28*a* when the probe is retracted (see FIG. 13A).

In another embodiment, shown in FIG. 14, a first annular groove is formed in the wall of the upper bore region 28*a* in the protuberance, and a second annular groove is formed in the side wall of the cover 32'. The first and second annular grooves align to form a toroidal space when the cover is scoured about the probe. A shearable ring 34 is disposed in the toroidal space for releasably securing the cover 32' to the bore region 28*a*.

Alternatively, with reference to FIG. 15, an annular groove 29 is formed in the wall of the bore region 28*a* in the rib 14, and the side wall of the cover 32" is equipped with a shearable annular flange 33 at an end thereof adapted to fit the annular groove 29.

Still further, with reference now to FIGS. 16–19, the inventive apparatus 10 may include a backup support 40 carried by the tubular body 12 azimuthally (radially) opposite the probe 22 (compare also FIG. 4 with FIGS. 5–6) and movable between retracted and extended positions. The backup support 40 is designed to shear at a preselected location upon encountering a predetermined shear load. A backup support actuator is also carried by the tubular body for moving the backup support between its retracted and extended positions, as mentioned above. The extended position is for assisting the engagement of the probe with the wall of the wellbore by increasing the well bore wall contact surface with the back-up support, and thus the reactive force delivered through the apparatus 10 to the probe 22 when the backup support is extended. The retracted position serves to protect the backup support while drilling.

In the embodiment shown in FIGS. 16–17, the backup support 40 includes a piston body 42 carried within a bore 41 in the tubular body 12 for movement between extended and retracted positions. The back-up support further includes a piston head 44 carried at least partially within a bore in the piston body 42 for movement between the extended and retracted positions. The piston head 44 is designed to shear upon encountering the predetermined shear load.

The shear design of the piston head 44 may be accomplished by material selection. For example, the piston head may includes a material having a relatively low shear strength. Suitable materials include aluminum alloys and oriented strand composites. The shear may be achieved by erosion and/or by shear failure.

The shear (i.e., sacrificial) design of the piston head 44 may also be accomplished either independently or in combination with material selection by mechanical tuning. For example, the piston head 44 may include a central base 46 formed of metal and an outer composite jacket 48 secured about the central base. In this embodiment, the central base 46 may have grooves formed therein for mechanical engagement by the composite jacket. Such grooves may additionally serve as preferential shear failure sites, since they will reduce the load-bearing cross-sectional area of the piston head 44. The central base should also be made from a drillable material as large pieces can break off and wind up in the wellbore when the piston head fails.

Figure 16B:
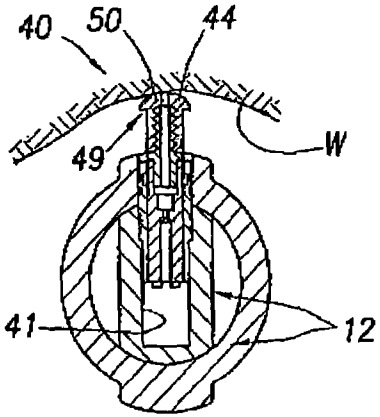
FIGS. 16A–16B are axial and radial cross-sectional views of a portion of an apparatus for acquiring information from a subsurface formation in accordance with a fourth aspect of the present invention, the apparatus having a back-up support moved to an extended position.

More particularly, the composite jacket 48 has an enlarged outer diameter at a distal end, forming a mushroom-shaped head 50 having a shoulder 49 (see FIG. 16B). The shoulder 49 has radial grooves formed therein providing channels for debris to flow clear of the shoulder, thereby reducing the likelihood of debris becoming trapped between the head 50 and the tubular body 12 when the piston head is moved to its retracted position.

Those skilled in the art will appreciate that the piston body 42 remains recessed in the tubular body 12 of the apparatus 10 even when the back-up support 40 is fully extended. This leaves only the piston head 44 extending from the tool. The body 42 of the piston contains all sealing surfaces between the "clean" hydraulics within the apparatus 10 and the mud in the wellbore. In the event of a failure whereby apparatus 10 becomes stuck in the wellbore W, the apparatus could be pulled free, causing the piston head 44 to undergo shear failure (see FIGS. 17A–17B) without damaging the main body 42 of the piston or unsealing the hydraulics. Since the material of the piston head is drillable, even large pieces would not interfere with the drilling process.

Figure 17B:
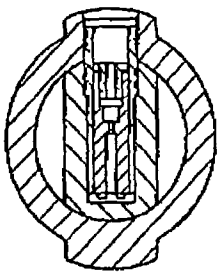
FIGS. 17A–17B are axial and radial cross-sectional views of the back-up support moved to a retracted position after a portion of the back-up support has been sheared away.
Figure 16A:
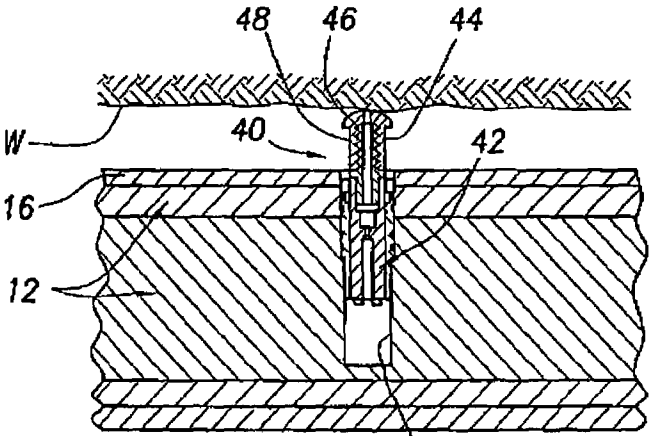
Figure 17A:
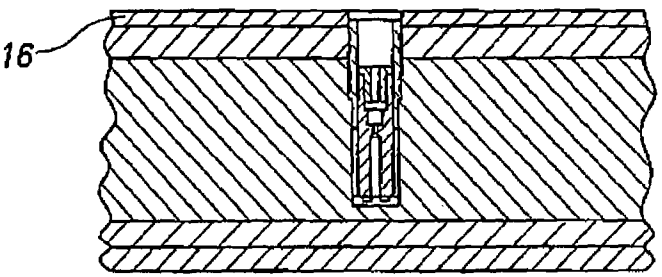

FIGS. 16A–16B show both axial and radial cross-sections through the back-up support 40, with the support being fully extended. Again, the piston body 42 remains completely recessed within the outer diameter of the tubular body 12, even in the fully extended position. FIGS. 17A–17B show the piston body 42 in its fully retracted state, sans a portion of the piston head 44 which has been sheared away.

When the apparatus 10 is set and retrieval is necessary, there are several failure modes that the piston head 42 can take depending on the amount it is extended and the rugosity of the wellbore wall W. If the piston head is only extended partially, as in a hole that is only slightly larger than the diameter of the apparatus 10, the piston material may only erode from abrasion against the wellbore wall W as the tool is removed. In a larger diameter hole, or a very rugose hole, the piston head 44 would likely shear into large pieces upon retrieval as there would be a large moment around the base of the piston and a high likelihood that the piston head could get caught on a ledge or similar obstruction in the wellbore.

As mentioned above, the material(s) of the piston head 44 can be "tuned" for strength, elasticity, abrasion, and erosion resistance. In its simplest form the piston head could be made from a low strength metal such as an aluminum alloy. Another option is an oriented strand composite. This option could be used to customize both the compressive and shear properties of the piston head almost independently of one another. With this ability, the piston head could be made extremely strong in compression for normal setting purposes and relatively weak in shear to enable it to fail at a reasonable pull force for a wireline application or the drill pipe.

Figure 18:
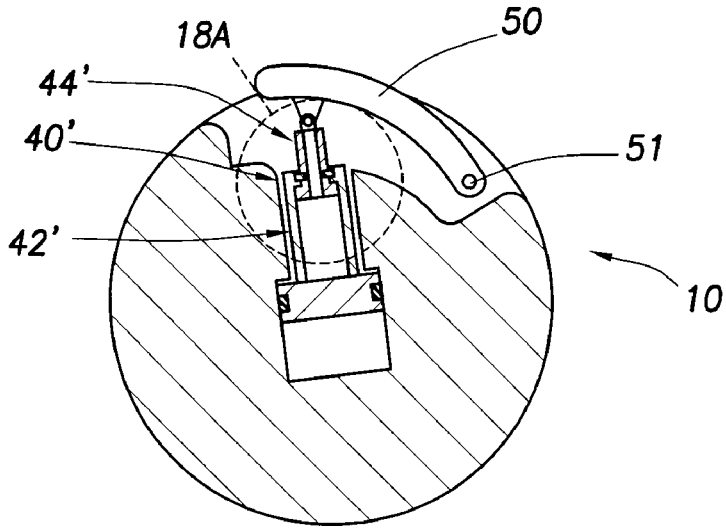
FIG. 18 is a cross-sectional view of a drill string apparatus having an alternative back-up support to that shown in FIGS. 16A–16B.
Figure 18A:
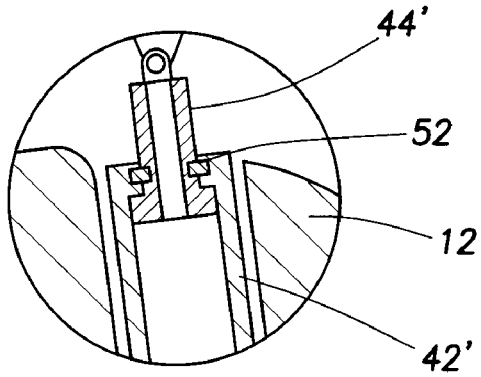
FIG. 18A is an enlarged, detailed view of a portion of the back-up support shown in FIG. 18.
Figure 19:
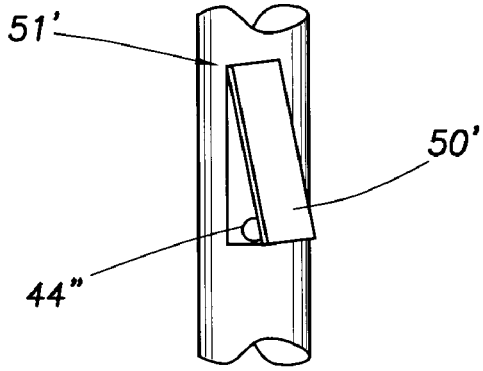
FIG. 19 is a perspective view of a portion of a drill string having an alternative back-up support to that shown in FIG. 18.

Turning now to FIGS. 18–19, the piston head 44' can be made to collapse within the piston body 42' of the back-up support 40' rather than shearing or abrading or eroding the back-up support. This is accomplished with the use of shear pins 52 to connect the piston head and piston body 42', and a plate or "shoe" 50 hinged at pin 51 to supply an axial load to the shear pins 52 when the shoe 50 is loaded by an amount (e.g., via vigorous engagement with wellbore wall W) that exceeds the predetermined shear threshold.

The hinged shoe 50' can be oriented axially (see FIG. 19) rather than radially (as in FIG. 18) to apply the desired load to shear pins 52, depending on the preferred method of retraction. If rotation of the apparatus 10 is the preferred method, the hinged shoe 50 should be oriented as shown in FIG. 18. If pulling axially on the drill string would be the preferred method of extraction of the apparatus 10, the hinged shoe 50' should be oriented as shown in FIG. 19. The advantage of this method versus the previously described method is that there are no large pieces left in the hole, although it sacrifices simplicity.

It will be understood from the foregoing description that various modifications and changes may be made in the preferred and alternative embodiments of the present invention without departing from its true spirit.

This description is intended for purposes of illustration only and should not be construed in a limiting sense. The scope of this invention should be determined only by the language of the claims that follow. The term "comprising" within the claims is intended to mean "including at least" such that the recited listing of elements in a claim are an open group. "A," "an" and other singular terms are intended to include the plural forms thereof unless specifically excluded.

We claim:

1. An apparatus for acquiring information from a subsurface formation penetrated by a wellbore, comprising:

a tubular body adapted for connection within a drill string disposed in the wellbore, the body being equipped with one or more protuberances along an axial portion thereof defining an expanded axial portion, the protuberances having a first end, a second end and an intermediate portion therebetween, the cross-sectional area of the expanded axial portion about the intermediate portion being less than the cross-sectional area of the expanded axial portion about at least one of the ends;

a probe carried by the body at or near a first location within the intermediate portion, the probe being movable between retracted and extended positions; and an actuator carried by the body for moving the probe between its retracted and extended positions, the extended position being for engaging the wall of the wellbore and acquiring information from the formation, and the retracted position being for protecting the probe while drilling.

2. The apparatus of claim 1, wherein the tubular body is a drill collar.

3. The apparatus of claim 1, wherein the tubular body is a stabilizer equipped with a plurality of ribs for stabilizing the drill string.

4. The apparatus of claim 1, wherein the tubular body is a centralizer equipped with a plurality of ribs for centralizing the drill string.

5. The apparatus of claim 1, wherein the body is equipped with a first rib that spans substantially the length of the expanded axial portion, and second and third ribs each having a length less than half the Length of the first rib and disposed on opposing sides of the midpoint of the expanded axial portion, and the first location lies at the midpoint of the expanded axial portion.

6. The apparatus of claim 5, wherein the body is further equipped with a fourth rib that spans substantially the length of the expanded axial portion radially opposite the first rib.

7. The apparatus of claim 5, wherein the first rib is helicoidal near its ends and axially linear intermediate its ends.

8. The apparatus of claim 5, wherein the ribs are one of helicoidal, oblique, and axially linear.

9. The apparatus of claim 5, wherein one or more of the ribs has a thickness that varies over its length.

10. The apparatus of claim 1, wherein the probe includes a conduit disposed within an annular seal.

11. The apparatus of claim 1, wherein the actuator employs hydraulic fluid to move the probe.

12. The apparatus of claim 1, wherein the actuator employs electrical power to move the probe.

13. The apparatus of claim 10, further comprising a sensor in fluid communication with the conduit for measuring a property of the formation.

14. The apparatus of claim 13, wherein the sensor is a pressure sensor for measuring the pore pressure of the formation.

15. The apparatus of claim 1, wherein:

the first location lies on a protuberance within the expanded axial portion; and the probe is at least partially carried within a channel formed in the protuberance at or near the first location, the protuberance extending radially beyond the retracted probe such that the probe is recessed within the protuberance when the probe is retracted, the channel having a width sized for closely bounding a portion of the probe and the channel extending azimuthally from the probe through one side of the protuberance, whereby wellbore debris is free to flow along the channel away from the probe during drilling.

16. The apparatus of claim 15, wherein the channel extends azimuthally in a clockwise direction from the probe.

17. The apparatus of claim 1, further comprising:

a cover releasably-secured about the probe for protecting the probe while drilling prior to the probe being first moved to its extended position; and wherein the movement of the probe by the actuator to the probe's extended position releases the cover from the probe and positions the probe in engagement with the wall of the wellbore for acquiring information from the formation.

18. The apparatus of claim 1, further comprising a backup support carried by the body azimuthally opposite the probe and movable between retracted and extended positions, the backup support being designed to shear at a preselected location upon encountering a predetermined shear load; and a backup support actuator carried by the body for moving the backup support between its retracted and extended positions, the extended position being for assisting the engagement of the probe with the wall of the wellbore, and the retracted position being for protecting the backup support while drilling.

19. The apparatus of claim 1, wherein the probe is substantially cylindrical and is carried for movement within a bore in the protuberance.

20. The apparatus of claim 15, wherein the probe is substantially cylindrical and is carried for movement within a bore in the protuberance, the bore penetrating the channel.

21. An apparatus for acquiring information from a subsurface formation penetrated by a wellbore, comprising:

a tubular body adapted for connection within a drill swing disposed in the wellbore;

a probe at least partially carried within a channel formed in a protruding portion of the body for movement of the probe between retracted and extended positions, the protruding portion extending radially beyond the probe such that the probe is recessed within the protuberance when the probe is retracted, the channel having a width sized for closely bounding a portion of the probe, the channel extending azimuthally from the probe through one side of the protuberance, whereby wellbore debris is free to flow along the channel away from the probe during drilling; and an actuator carried by the body for moving the probe between its retracted and extended positions, the extended position disposing the probe radially beyond the protruded portion of the body for engaging the wall of the wellbore and acquiring information from the formation, and the retracted position being for protecting the probe while drilling.

22. The apparatus of claim 21, wherein the channel extends azimuthally in a clockwise direction from the probe.

23. The apparatus of claim 21, wherein the tubular body is a drill collar.

24. The apparatus of claim 21, wherein the tubular body is a stabilizer equipped with a plurality of ribs for stabilizing the drill string.

25. The apparatus of claim 21, wherein the tubular body is a centralizer equipped with a plurality of ribs for centralizing the drill string.

26. The apparatus of claim 21, wherein the probe includes a conduit disposed within an annular seal.

27. The apparatus of claim 21, wherein the actuator employs hydraulically fluid to move the probe.

28. The apparatus of claim 21, wherein the actuator employs electrical power to move the probe.

29. The apparatus of claim 26, further comprising a sensor in fluid communication with the conduit for measuring a property of the formation.

30. The apparatus of claim 29, wherein the sensor is a pressure sensor for measuring the pore pressure of the formation.

31. The apparatus of claim 21, wherein:

the tubular body is equipped with one or more protuberances along an axial portion thereof defining an expanded axial portion; and the probe is carried by the body at or near a first location within the expanded axial portion of the body where the cross-sectional area of the expanded axial portion is a minimum for movement of the probe between retracted and extended positions.

32. The apparatus of claim 31, wherein the body is equipped with a first rib that spans substantially the length of the expanded axial portion, and second and third ribs each having a length less than half the length of the first rib and disposed on opposing sides of the midpoint of the expanded axial portion, and the first location lies at the midpoint of the expanded axial portion.

33. The apparatus of claim 32, wherein the body is further equipped with a fourth rib that spans substantially the length of the expanded axial portion radially opposite the first rib.

34. The apparatus of claim 32, wherein the first rib is helicoidal near its ends and axially linear intermediate its ends.

35. The apparatus of claim 32, wherein the ribs are one of helicoidal, oblique, and axially linear.

36. The apparatus of claim 32, wherein one or more of the ribs has a thickness that varies over its length.

37. The apparatus of claim 21, further comprising:

a cover releasably-secured about the probe for protecting the probe while drilling prior to the probe being first moved to its extended position; and wherein the movement of the probe by the actuator to the probe's extended position releases the cover from the probe and positioning the probe in engagement with the wall of the wellbore for acquiring information from the formation.

38. The apparatus of claim 21, further comprising a backup support carried by the body radially opposite the probe and movable between retracted and extended positions, the backup support being designed to shear at a preselected location upon encountering a predetermined shear load; and a backup support actuator carried by the body for moving the backup support between its retracted and extended positions, the extended position being for assisting the engagement of the probe with the wall of the wellbore, and the retracted position being for protecting the backup support while drilling.

39. An apparatus for acquiring information from a subsurface formation penetrated by a wellbore, comprising:

a tubular body adapted for connection within a drill string disposed in the wellbore;

a probe carried by the body for movement of the probe between retracted and extended positions;

a cover releasably-secured about the probe for protecting the probe while drilling prior to the probe being first moved to its extended position; and an actuator carried by the body for moving the probe between its retracted and extended positions, the movement of the probe to its extended position releasing the cover from the probe and positioning the probe in engagement with the wall of the wellbore for acquiring information from the formation, the movement of the probe to its retracted position being for protecting the probe while drilling.

40. The apparatus of claim 39, wherein:

the probe is substantially cylindrical and carried for movement within a bore in a protuberance formed along a portion of the body; and the cover has a continuous cylindrical side wall sized to closely fit in an annulus formed between the probe and the wall of the bore in the protuberance when the probe is retracted.

41. The apparatus of claim 40, wherein:

a first annular groove is formed in the wall of the bore in the protuberance; and a second annular groove is formed in the side wall of the cover;

the first and second grooves aligning to form a toroidal space when the cover is secured about the probe; and a shearable ring disposed in the toroidal space for releasably securing the cover to the bore of the protuberance.

42. The apparatus of claim 40, wherein:

an annular groove is formed in the wall of the bore in the protuberance; and the side wall of the cover is equipped with a shearable annular flange at an end thereof adapted to fit the annular groove.

43. The apparatus of claim 39, wherein the tubular body is a drill collar.

44. The apparatus of claim 39, wherein the tubular body is a stabilizer equipped with a plurality of ribs for stabilizing the drill string.

45. The apparatus of claim 39, wherein the tubular body is a centralizer equipped with a plurality of ribs for centralizing the drill string.

46. The apparatus of claim 39, wherein the probe includes a conduit disposed within an annular seal.

47. The apparatus of claim 39, wherein the actuator employs hydraulically fluid to move the probe.

48. The apparatus of claim 39, wherein the actuator employs electrical power to move the probe.

49. The apparatus of claim 46, further comprising a sensor in fluid communication with the conduit for measuring a property of the formation.

50. The apparatus of claim 49, wherein the sensor is a pressure sensor for measuring the pore pressure of the formation.

51. The apparatus of claim 39, wherein the tubular body is equipped with one or more protuberances along an axial portion thereof defining an expanded axial portion; and the probe is carried by the body at or near a first location within the expanded axial portion of the body where the cross-sectional area of the expanded axial portion is a minimum for movement of the probe between retracted and extended positions.

52. The apparatus of claim 51, wherein the body is equipped with a first rib that spans substantially the length of the expanded axial portion, and second and third ribs each having a length less than half the length of the first rib and disposed on opposing sides of the midpoint of the expanded axial portion, and the first location has at the midpoint of the expanded axial portion.

53. The apparatus of claim 52, wherein the body is further equipped with a fourth rib that spans substantially the length of the expanded axial portion radially opposite the first rib.

54. The apparatus of claim 52, wherein the first rib is helicoidal near its ends and axially linear intermediate its ends.

55. The apparatus of claim 52, wherein the ribs are one of helicoidal, oblique, and axially linear.

56. The apparatus of claim 52, wherein one or more of the ribs has a thickness that vanes over its length.

57. The apparatus of claim 39, further comprising a backup support carried by the body radially opposite the probe and movable between retracted and extended positions, the backup support being designed to shear at a preselected location upon encountering a predetermined shear load; and a backup support actuator carried by the body for moving the backup support between its retracted and extended positions, the extended position being for assisting the engagement of the probe with the wall of the wellbore, and the retracted position being for protecting the backup support while drilling.

58. An apparatus for acquiring information from a subsurface formation penetrated by a wellbore, comprising:

a tubular body adapted for connection within a drill string or along a wireline disposed in the wellbore;

a probe carried by the body for movement of the probe between retracted and extended positions;

a backup support carried by the body radially opposite the probe and movable between retracted and extended positions, the backup support being designed to shear at a preselected location upon encountering a predetermined shear load;

a probe actuator carried by the body for moving the probe between its retracted and extended positions, the extended position being for engaging the wall of the wellbore and acquiring information from the formation, and the retracted position being for protecting the probe while drilling; and a backup support actuator carried by the body for moving the backup support between its retracted and extended positions, the extended position being for assisting the engagement of the probe with the wall of the wellbore, and the retracted position being for protecting the backup support while drilling.

59. The apparatus of claim 58, wherein the backup support includes a piston body carried within a bore in the tubular body for movement between extended and retracted positions, and a piston head carried at least partially within a bore in the piston body for movement between extended and retracted positions, the piston head being designed to shear upon encountering the predetermined shear load.

60. The apparatus of claim 59, wherein the piston head includes a material having a relatively low shear strength.

61. The apparatus of claim 60, wherein the material is an aluminum alloy.

62. The apparatus of claim 60, wherein the material is an oriented strand composite.

63. The apparatus of claim 59, wherein the piston head is designed to shear by erosion.

64. The apparatus of claim 59, wherein the piston head is designed to shear by shear failure.

65. The apparatus of claim 59, wherein the piston head includes a central base formed of metal and an outer composite jacket secured about the central base.

66. The apparatus of claim 65, wherein the central base has grooves formed therein for engagement by the composite jacket.

67. The apparatus of claim 66, wherein the grooves serve as preferential shear failure sites.

68. The apparatus of claim 65, wherein the composite jacket has an enlarged outer diameter at a distal end, forming a mushroom-shaped head having a shoulder.

69. The apparatus of claim 68, wherein the shoulder has radial grooves formed therein providing channels for debris to flow clear of the shoulder, thereby reducing the likelihood of debris becoming trapped between the head and the tubular body when the piston head is moved to its retracted position.

70. The apparatus of claim 58, wherein the tubular body is a drill collar.

71. The apparatus of claim 58, wherein the tubular body is a stabilizer equipped with a plurality of ribs for stabilizing the drill string.

72. The apparatus of claim 58, wherein the tubular body is a centralizer equipped with a plurality of ribs for centralizing the drill string.

73. The apparatus of claim 58, wherein the probe includes a conduit disposed within an annular seal.

74. The apparatus of claim 58, wherein the actuator employs hydraulically fluid to move the probe.

75. The apparatus of claim 58, wherein the actuator employs electrical power to move the probe.

76. The apparatus of claim 73, further comprising a sensor in fluid communication with the conduit for measuring a property of the formation.

77. The apparatus of claim 76, wherein the sensor is a pressure sensor for measuring the pore pressure of the formation.

78. The apparatus of claim 58, wherein the tubular body is equipped with one or more protuberances along an axial portion thereof defining an expanded axial portion; and the probe is carried by the body at or near a first location within the expanded axial portion of the body where the cross-sectional area of the expanded axial portion is a minimum for movement of the probe between retracted and extended positions.

79. The apparatus of claim 78, wherein the body is equipped with a first rib that spans substantially the length of the expanded axial portion, and second and third ribs each having a length less than half the length of the first rib and disposed on opposing sides of the midpoint of the expanded axial portion, and the first location lies at the midpoint of the expanded axial portion.

80. The apparatus of claim 79, wherein the body is further equipped with a fourth rib that spans substantially the length of the expanded axial portion radially opposite the first rib.

81. The apparatus of claim 79, wherein the first rib is helicoidal near its ends and axially linear intermediate its ends.

82. The apparatus of claim 79, wherein the ribs are one of helicoidal, oblique, and axially linear.

83. The apparatus of claim 79, wherein one or more of the ribs has a thickness that varies over its length.

84. A method of acquiring information from a subsurface formation penetrated by a wellbore, comprising the steps of:

equipping a tubular body with one or more protuberances along an axial portion thereof defining an expanded axial portion, the protuberances having a first end, a second end and an intermediate portion therebetween, the cross-sectional area of the expanded axial portion about the intermediate portion being less than the cross-sectional area of the expanded axial portion about at least one of the ends; and a movable probe at or near a first location on the tubular body within the intermediate portion;

connecting the tubular body within a drill string;

disposing the drill string within the wellbore; and selectively extending the probe such that the probe engages the wall of the wellbore for acquiring information from the formation, and retracting the probe to protect the probe while drilling.

85. A method for acquiring information from a subsurface formation penetrated by a wellbore, comprising:

equipping a tubular body with a protruding portion having a channel formed therein, the channel extending transversely through at least one side of the protruding portion, and a movable probe carried at least partially within the channel;

connecting the tubular body within a drill string;

disposing the drill string within the wellbore; and selectively extending the probe such that the probe engages the wall of the wellbore for acquiring information from the formation, and retracting the probe to a recessed position within the protruded portion whereby wellbore debris is free to flow along the channel away from the probe during drilling.

86. A method of acquiring information from a subsurface formation penetrated by a wellbore, comprising:

equipping a tubular body with a movable probe having a releasable cover, the cover being released by extension of the probe from a retracted position;

connecting the tubular body within a drill string;

disposing the drill string within the wellbore; and selectively extending the probe from the retracted position to release the cover and move the probe into engagement with the wall of the wellbore for acquiring information from the formation, and retracting the probe to the retracted position to protect the probe while drilling.

87. An apparatus for acquiring information from a subsurface formation penetrated by a wellbore, comprising:

equipping a tubular body with a movable probe, and a movable backup support positioned radially opposite the probe, the backup support being designed to shear at a preselected location upon encountering a predetermined shear load;

connecting the tubular body within a drill string;

disposing the drill string within the wellbore;

selectively extending the probe into engagement with the wall of the wellbore for acquiring information from the formation, and retracting the probe to protect the probe while drilling; and selectively extending the backup support into engagement with the wall of the wellbore radially opposite the probe to supplement the engagement by the probe with the wellbore wall, retracting the backup support as required while drilling and upon failure to retract the backup support applying a shear load at least as great as the predetermined shear load to the backup support to shear the backup support at the preselected location.

* * * * *